US008585889B2

(12) United States Patent
Kim et al.

(10) Patent No.: US 8,585,889 B2
(45) Date of Patent: Nov. 19, 2013

(54) PROCESS FOR MANUFACTURING HIGH QUALITY NAPHTHENIC BASE OILS

(75) Inventors: Chang Kuk Kim, Seoul (KR); Jee Sun Shin, Seoul (KR); Kyung Seok Noh, Gyeonggi-do (KR); Ju Hyun Lee, Daejeon (KR); Byoung In Lee, Daejeon (KR); Seung Woo Lee, Daejeon (KR); Do Woan Kim, Daejeon (KR); Sam Ryong Park, Daejeon (KR); Seong Han Song, Gyeonggi-do (KR); Gyung Rok Kim, Daejeon (KR); Yoon Mang Hwang, Daejeon (KR)

(73) Assignee: SK Lubricants Co., Ltd. (KR)

( * ) Notice: Subject to any disclaimer, the term of this patent is extended or adjusted under 35 U.S.C. 154(b) by 428 days.

(21) Appl. No.: 12/999,415

(22) PCT Filed: Aug. 7, 2008

(86) PCT No.: PCT/KR2008/004594

§ 371 (c)(1),
(2), (4) Date: Dec. 16, 2010

(87) PCT Pub. No.: WO2009/154324

PCT Pub. Date: Dec. 23, 2009

(65) Prior Publication Data

US 2011/0089080 A1 Apr. 21, 2011

(30) Foreign Application Priority Data

Jun. 17, 2008 (KR) ..... 10-2008-0056855

(51) Int. Cl.
*C10G 69/02* (2006.01)

(52) U.S. Cl.
USPC ..... 208/60; 208/65

(58) Field of Classification Search
USPC ..... 208/65
See application file for complete search history.

(56) References Cited

U.S. PATENT DOCUMENTS

| | | | | |
|---|---|---|---|---|
| 4,427,531 | A | 1/1984 | Dickakian | |
| 5,242,578 | A | 9/1993 | Taylor | |
| 7,279,090 | B2 | 10/2007 | Colyar | |
| 7,282,137 | B2 | 10/2007 | Cody | |
| 2002/0189972 | A1 * | 12/2002 | Benazzi et al. | 208/57 |
| 2006/0186021 | A1 * | 8/2006 | Marchionna et al. | 208/96 |

FOREIGN PATENT DOCUMENTS

| | | | |
|---|---|---|---|
| JP | 58-47089 | | 3/1983 |
| JP | 59-027985 | | 2/1984 |
| JP | 2003-531276 | | 10/2003 |
| KR | 10-2003-0075216 | A | 9/2003 |
| KR | 1020030075216 | * | 9/2003 |
| WO | WO93/02160 | * | 2/1993 |

OTHER PUBLICATIONS

Fenske et al, Separation and Composition of a Lubricating Oil Distillate, Ind. Eng. Chem., 1941, 33 (3), pp. 331-338.*

* cited by examiner

*Primary Examiner* — Randy Boyer
*Assistant Examiner* — Juan Valencia
(74) *Attorney, Agent, or Firm* — DLA Piper LLP (US)

(57) ABSTRACT

A method of manufacturing high-quality naphthenic base oils comprising a high aromatic content and a large amount of impurities with a boiling point higher than that of gasoline. High-quality naphthenic base oil may be manufactured from light cycle oil (LCO) and slurry oil (SLO), which are inexpensive, and have a high aromatic content, a large amount of impurities, and which are effluents of a fluidized catalytic cracking (FCC) unit. The method also relates to the pretreatment process of a feedstock, where the amounts of impurities (sulfur, nitrogen, polynuclear aromatic compounds and various metals components) in the feedstock are reduced.

15 Claims, 1 Drawing Sheet

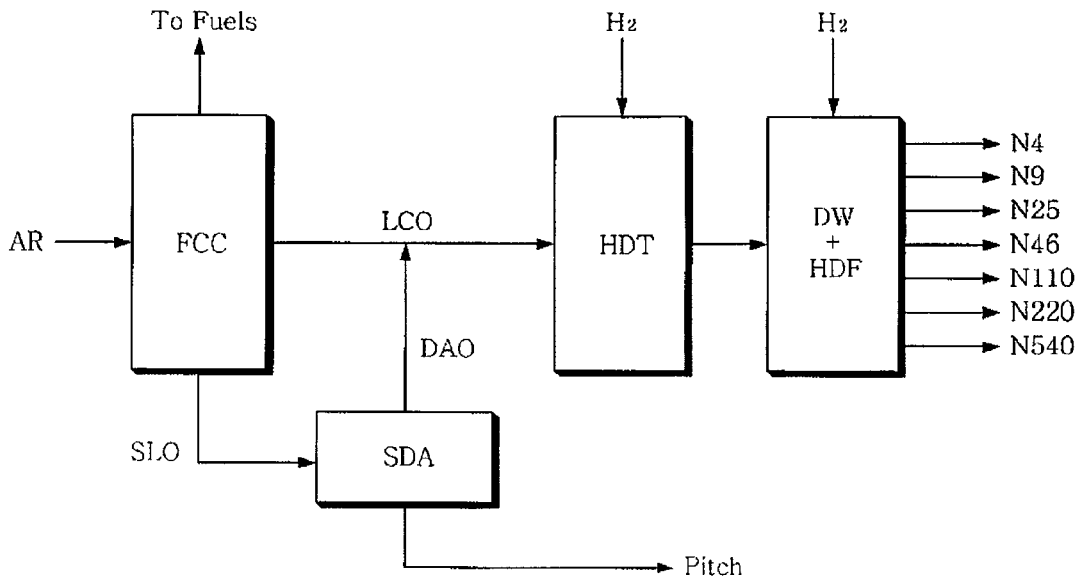
To Fuels
H2
H2
AR
FCC
LCO
HDT
DW
+
HDF
N4
N9
N25
N46
N110
N220
N540
DAO
SLO
SDA
Pitch

PROCESS FOR MANUFACTURING HIGH QUALITY NAPHTHENIC BASE OILS

RELATED APPLICATIONS

This is a §371 of International Application No. PCT/KR2008/004594, with an international filing date of Aug. 7, 2008 (WO 2009/154324A1, published Dec. 23, 2009, which is based on Korean Patent Application No. 10-20080056855 filed Jun. 17, 2008.

TECHNICAL FIELD

The present disclosure relates to a method of manufacturing naphthenic base oil from hydrocarbon oil fractions having a high aromatic content and a large amount of impurities, and more particularly, to a method of manufacturing high-quality naphthenic base oil by passing, as a feedstock, deasphalted oil (DAO) obtained through solvent deasphalting (SDA) of slurry oil (SLO) that is an effluent of a fluidized catalytic cracking (FCC) unit, to a hydrotreating unit and a dewaxing/hydrofinishing unit.

BACKGROUND

Naphthenic base oil has been base oil that has a viscosity index of 85 or less and in which at least 30% of the carbon bonds of the base oil are of a naphthenic type according to ASTM D-2140.

Recently, naphthenic base oil is widely used in various industrial fields for a variety of purposes, including transformer oil, insulation oil, refrigerator oil, oil for processing rubber and plastic, fundamental material of print ink or grease, and base oil for metal processing oil.

Conventional methods of manufacturing naphthenic base oil are mainly conducted in such a manner that naphthenic crude oil having high naphthene content (naphthene content: 30-40%), serving as a feedstock, is passed through a vacuum distillation unit to thus separate a paraffinic component and then through extraction and/or hydrogenation units to thus separate an aromatic component and/or convert it into naphthene, after which impurities are removed.

However, the conventional methods are problematic in that the essential use of the naphthenic crude oil having high naphthene content as the feedstock encounters a limitation in the supply thereof, and furthermore, the extraction procedure for extracting the aromatic component must be conducted, undesirably lowering the total product yield and deteriorating the quality of the product.

International Patent No. WO 2004/094565 discloses a method of manufacturing naphthenic base oil by subjecting a mixture composed of effluents of various process units, serving as a feedstock, to hydrofining to thus obtain oil fractions, which are then stripped to separate only an oil fraction having a boiling point within a predetermined range, and then dewaxing the separated oil fraction. However, the above method is disadvantageous because, among effluents of the hydrofining unit, only a middle oil fraction, excluding a light oil fraction and a heavy bottom oil fraction, is used to produce the naphthenic base oil, undesirably lowering the total product yield. Further, because the removing of impurities during the hydrofining process is not sufficiently performed, sulfur is contained in a large amount in the middle oil fraction separated through stripping, remarkably reducing the activity and selectivity of a catalyst used in a downstream dewaxing unit.

In addition, methods of increasing the total process yield are required.

SUMMARY

Accordingly, the present disclosure provides a method of manufacturing expensive naphthenic base oil in high yield from an inexpensive hydrocarbon feedstock having a high aromatic content and a large amount of impurities, in which slurry oil that is an FCC effluent is subjected to solvent deasphalting, thereby increasing the yield of the slurry oil fraction which may be stably treated, consequently minimizing the loss and removal of the oil fraction.

According to the present disclosure, a method of manufacturing naphthenic base oil from a hydrocarbon feedstock having a boiling point higher than that of gasoline and containing heteroatom species and an aromatic material may comprise (a) separating light cycle oil and slurry oil from oil fractions obtained through FCC, (b) separating the slurry oil separated in (a) into deasphalted oil and a pitch through solvent deasphalting, (c) hydrotreating the light cycle oil separated in (a), the deasphalted oil separated in (b), or a mixture thereof, using a hydrotreating catalyst, thus reducing the amount of the heteroatom species, (d) dewaxing the hydrotreated oil fraction, obtained in (c), using a dewaxing catalyst, thus lowering a pour point, (e) hydrofinishing the dewaxed oil fraction, obtained in (d), using a hydrofinishing catalyst, thus adjusting an aromatic content to comply with a product standard, and (f) separating the hydrofinished oil fraction, obtained in (e), according to a range of viscosity.

In the present disclosure, deasphalted oil obtained through solvent deasphalting of slurry oil that is an FCC effluent is used as a feedstock. The separation using solvent extraction causes the deasphalted oil to have smaller amounts of impurities (sulfur, nitrogen, polynuclear aromatic compounds and various metal components) than those of slurry oil obtained through simple distillation, and thus extreme operating conditions of a downstream hydrotreating unit can be mitigated and the lifetime of the catalyst used can be lengthened. Further, the yield of the slurry oil fraction which is stably treatable can be increased, ultimately increasing the total process yield.

BRIEF DESCRIPTION OF THE DRAWINGS

FIG. 1 is a schematic view showing the process of manufacturing naphthenic base oil, according to the present disclosure. The following is a key for FIG. 1:

AR: atmospheric residue
FCC: fluidized catalytic cracking
LCO: light cycle oil
SLO: slurry oil
DAO: deasphalted oil, which is obtained through solvent deasphalting of slurry oil
HDT: hydrotreating DW: dewaxing HDF: hydrofinishing N4/9/25/46/110/220/540: naphthenic base oil products (in which the number indicates kinetic viscosity at 40° C.).

DETAILED DESCRIPTION

Hereinafter, a detailed description will be given of the present disclosure.

With reference to FIG. 1, the process of manufacturing naphthenic base oil according to the present disclosure includes subjecting slurry oil (SLO) obtained through FCC of petroleum hydrocarbons to solvent deasphalting (SDA), thus producing deasphalted oil (DAO); supplying light cycle oil (LCO), deasphalted oil (DAO), or a mixture thereof to a hydrotreating unit, thus performing hydrotreating (HDT); supplying the hydrotreated oil fraction to a dewaxing unit, thus performing dewaxing (DW); hydrofinishing the dewaxed oil fraction; and separating the hydrofinished oil fraction according to the range of viscosity.

The method of manufacturing the naphthenic base oil according to the present disclosure is characterized in that the naphthenic base oil is produced from light cycle oil or slurry oil having a high aromatic content and a large amount of impurities, which has been separated from product effluents obtained through FCC of petroleum hydrocarbons.

The light cycle oil or slurry oil used in the present disclosure is produced through FCC. The FCC (Fluidized Catalytic Cracking) process is an operation for producing a light petroleum product by subjecting an atmospheric residue feedstock to FCC under temperature/pressure conditions of 500-700° C. and 1~3 atm. Such an FCC process enables the production of a volatile oil fraction, as a main product, and propylene, heavy cracked naphtha (HCN), light cycle oil, slurry oil, etc., as by-products. The light cycle oil or slurry oil, but not the light oil fraction, is separated using a separation tower. Because this oil has a large amount of impurities and a high content of heteroatom species and aromatic material, it is difficult to use as a light oil fraction, which is a highly valued product, and is instead mainly used for high-sulfur light oil products or inexpensive heavy fuel oils.

In the method according to the present disclosure, as shown in FIG., the high-quality naphthenic base oil can be manufactured from the deasphalted oil or mixture of light cycle oil and deasphalted oil, in which the deasphalted oil is produced by introducing atmospheric residue (AR) to an FCC unit, thus obtaining the light cycle oil (LCO) and slurry oil (SLO), which are then separated from each other, and subjecting the separated slurry oil to solvent deasphalting. The light cycle oil is an oil fraction having a high aromatic content with a boiling point of 300~380° C. higher than that of gasoline, and the slurry oil is an oil fraction having a high aromatic content with a boiling point of 350~510° C. higher than that of gasoline.

The solvent deasphalting (SDA) process is an operation for separating the oil fraction through extraction using C3 or C4 as a solvent, and the operating conditions include a pressure of an asphaltene separator of 40-50 kg/cm$^2$, a separation temperature of deasphalted oil and pitch of 40-180° C., and a ratio of solvent to oil (L/kg) of 4:1-12:1.

For comparison, the properties of the light cycle oil, the deasphalted oil, and the mixture thereof, serving as the feedstock, are summarized in Table 1 below.

TABLE 1

| | | LCO | DAO | LCO + DAO |
|---|---|---|---|---|
| Yield (wt %) | | 100 | 70 | |
| Pour Point | ° C. | 0 | 11 | 3 |
| Kvis | 40° C. | 8.717 | 75.04 | 23.16 |
| | 100° C. | 2.046 | 5.954 | 3.413 |
| Sulfur | wt. ppm | 6600 | 6004 | 6300 |
| Nitrogen | wt. ppm | 1166 | 1425 | 1851 |
| HPNA | 11 ring+ | 70 | 93 | 169 |
| | Total | 239 | 394 | 481 |
| HPLC | MAH % | 5.40 | 5.83 | 6.1 |
| | DAH % | 13.70 | 7.33 | 19 |
| | PAH % | 55.80 | 59.08 | 42.89 |
| | TAH % | 74.80 | 72.24 | 67.99 |

Note:
HPNA: heavy polynuclear aromatics
MAH: mono-aromatic hydrocarbon
DAH: di-aromatic hydrocarbon
PAH: poly-aromatic hydrocarbon
TAH: total aromatic hydrocarbon As is apparent from Table 1, the above feedstocks have a sulfur content above 0.5 wt % and a nitrogen content above 1000 ppm. In the case of the feedstock of the present disclosure having a total aromatic content of 60 wt % or more, the amounts of impurities and aromatics are much higher than those of naphthenic crude oil which is used as a feedstock in a typical process for producing naphthenic base oil. For reference, naphthenic crude oil typically has an aromatic content of about 10-20%, a sulfur content of 0.1-0.15%, and a nitrogen content of about 500-1000 ppm.

The light cycle oil, the deasphalted oil, or the mixture thereof contains a high aromatic content and a large amount of impurities, and thus, sulfur, nitrogen, oxygen, and metal components contained therein are removed through hydrotreating (HDT) and the aromatic component contained therein is converted into a naphthenic component through hydrogen saturation.

In the method of manufacturing the naphthenic base oil according to the present disclosure the hydrotreating (HDT) process is conducted under conditions including a temperature of 280-430° C., a pressure of 30-220 kg/cm$^2$, a liquid hourly space velocity (LHSV) of 0.1-3.0 h$^{-1}$, and a volume ratio of hydrogen to feedstock of 500-2500 Nm$^3$m$^3$. When a large amount of hydrogen is supplied and extreme temperature/pressure conditions are applied, the amounts of aromatics and impurities contained in the feedstock may be drastically reduced.

The hydrotreating catalyst used in the hydrotreating process includes metals selected from among metals of Group 6 and Groups 9 and 10 in the periodic table, and in particular, contains one or more selected from among CoMo, NiMo, and a combination of CoMo and NiMo. However, the hydrotreating catalyst used in the present disclosure is not limited thereto, and any catalyst may be used so long as it is effective for the hydrogen saturation and removal of impurities.

The hydrotreated oil fraction has drastically reduced amounts of impurities and aromatics. In the method according to the present disclosure, the hydrotreated oil fraction has a sulfur content of less than 200 ppm, a nitrogen content of less than 100 ppm, and an aromatic content of less than 60 wt %. In particular, the amount of poly-aromatic hydrocarbon is decreased so that it is not more than 5%.

In the method according to the present disclosure, because the hydrotreated oil fraction contains considerably low amounts of impurities, reactions in downstream process units occur more stably, so that products enriched in naphthene with small amounts of impurities can be produced in high yield.

In the case where hydrotreating is conducted under optimal operating conditions as above, the entire hydrotreated oil fraction, with the sole exception of a gas component which is discharged, is supplied to the dewaxing unit, without the need for additional separation or removal of a light oil fraction or a bottom oil fraction.

The dewaxing process according to the present disclosure is an operation for decreasing the amount of normal paraffin through cracking or isomerization.

In the dewaxing process, the pour point standard directly related to the low-temperature performance of products is realized through selective reaction and isomerization of the paraffinic oil fraction.

More particularly, the dewaxing (DW) process is conducted under conditions including a temperature of 250-430° C., a pressure of 10-200 kg/cm$^2$, LHSV of 0.1-3 h$^{-1}$, and a volume ratio of hydrogen to feedstock of 300-1000 Nm$^3$/m$^3$.

The dewaxing catalyst used for the dewaxing process contains a support having an acid center selected from among a molecular sieve, alumina, and silica-alumina, and one or more metals selected from among metals of Group 6, 9, and 10 in the periodic table, in particular, metals having hydrogenation activity such as platinum, palladium, molybdenum, cobalt, nickel, and tungsten.

Examples of the support having an acid center include a molecular sieve, alumina, and silica-alumina. Among them, the molecular sieve includes crystalline aluminosilicate (zeolite), SAPO, ALPO or the like, examples of a medium pore molecular sieve having 10-membered oxygen ring including SAPO-I 1, SAPO-41, ZSM-5, ZSM-I 1, ZSM-22, ZSM-23, ZSM-35, and ZSM-48, and examples of a large pore molecular sieve having 12-membered oxygen ring include FAU, Beta and MOR.

The metal having hydrogenation activity includes one or more selected from among metals of Groups 6, 8, 9, and 10 in the periodic table. Particularly useful are Co and Ni as the metal of Groups 9 and 10 (i.e., Group VIII), and Mo and Was the metal of Group 6 (i.e., Group VIB).

In the present disclosure, a dewaxing catalyst composed of Ni(Co)/Mo(W) is used, and the effects thereof are as follows. Specifically, i) in terms of performance, the above catalyst exhibits dewaxing performance equal to that of a conventional dewaxing catalyst, and ii) in terms of economic efficiency, the above catalyst inhibits the heating reaction of the process and lowers hydrogen consumption, and as well, does not contain a noble metal, thus reducing catalyst expense. Also, iii) in terms of properties and stability, the above catalyst is able to prevent the saturation of the mono-aromatic component so as to adjust the gas absorptiveness of naphthenic base oil products through control of the reaction temperature of a hydrofinishing catalyst used in a downstream hydrofinishing unit, thereby realizing properties and stability adequate for the standards required for products in the hydrofinishing process. Also, iv) in terms of the conditions of a feedstock, because a catalyst containing a noble metal is subjected to relatively restrict regulation in the permissible content of impurities in the oil fraction, the conditions of the feedstock usable in the dewaxing process are mitigated. Also, v) in terms of the lifetime of a dewaxing catalyst, the dewaxing catalyst receives the oil fraction which has been refined through the hydrotreating process, and thereby the lifetime thereof can be increased.

Next, the hydrofinishing process according to the present disclosure is an operation for adjusting the aromatic content, gas absorptiveness, and oxidation stability of the dewaxed oil fraction in the presence of the hydrofinishing catalyst in order to comply with the standards required for products. The hydrofinishing process is conducted under conditions including a temperature of 150-400° C., a pressure of 10-200 $kg/cm^2$, LHSV of 0.1-3.0 $h^{-1}$, and a volume ratio of hydrogen to the supplied oil fraction of 300-1000 $Nm^3/m^3$.

The hydrofinishing catalyst used in the hydrofinishing process includes one or more metals having hydrogenation activity selected from metals of Groups 6, 8, 9, 10 and 11 in the periodic table. In particular, the hydrofinishing catalyst may include a composite metal selected from among Ni—Mo, Co—Mo, and Ni—W, or a noble metal selected from among Pt and Pd.

Examples of the support having a large surface area include silica, alumina, silica-alumina, titania, zirconia, and zeolite. Particularly useful is alumina or silica-alumina. The support functions to increase the dispersibility of the above metal to improve hydrogenation performance. As the function of the support, the control of the acid center for preventing cracking and coking of products is regarded as important.

For activation and pretreatment of the above catalysts (catalysts used for hydrotreating, dewaxing, and hydrofinishing), drying, reduction, and pre-sulfidation are required, and such pretreatment procedures maybe omitted or changed, if necessary.

Although the effluent, after having been subjected to all of hydrotreating dewaxing, and hydrofinishing, may be used as naphthenic base oil in that state, in the present disclosure, in consideration of various applications of naphthenic base oil, the final oil fraction is separated using a fractionator into a plurality of naphthenic base oil products having viscosities adequate for respective applications. For example, the separation process enables the oil fraction to be separated into naphthenic base oil products having kinetic viscosities at 40° C. of 3~5 cSt, 8-10 cSt. 18-28 cSt, 43-57 cSt, 90-120 cSt, 200-240 cSt, and 400 cSt or more.

A better understanding of the present disclosure may be obtained through the following examples, which are set forth to illustrate, but are not to be construed as to limit the present disclosure.

EXAMPLE 1

Production of Naphthenic Base Oil from Light Cycle Oil

A light cycle oil fraction having a boiling point of 300-380° C. was separated from FCC effluents and was then supplied to a hydrotreating unit.

The hydrotreating process was conducted using a nickel-molybdenum catalyst as a hydrotreating catalyst, under operating conditions including LHSV of 0.1-3.0 $h^{-1}$, a volume ratio of hydrogen to feedstock of 500-2500 $Nm^3/m^3$, a reaction pressure of 30-220 $kg/cm^2$, and a reaction temperature of 280-430° C.

After the hydrotreating process, the resultant middle oil fraction had a sulfur content of less than 200 ppm, a nitrogen content of less than 100 ppm, and an aromatic content of less than 70 wt %. According to a preferred embodiment, this oil fraction had a sulfur content of less than 100 ppm, a nitrogen content of less than 100 ppm, and an aromatic content of less than 50 wt %.

The dewaxing process was conducted using a NiMo/zeolite catalyst, and the hydrofinishing process was conducted using a $PtPd/Al^2O^3$ catalyst. These processes were carried out under operating conditions including LHSV of 0.1-3.0 $h^{-1}$, a volume ratio of hydrogen to feedstock of 300-1000 $Nm^3/m^3$, and a reaction pressure of 10-200 $kg/cm^2$. As such, the reaction temperature was set to 250-430° C. for dewaxing and 150-400° C. for hydrofinishing. In the case of the present example, the entire hydrofinished oil fraction could be used as a product without additional separation.

Table 2 below shows the properties of the feedstock (LCO) of the present example and the naphthenic base oil (product: N9)) obtained through hydrotreating and dewaxing of the feedstock. As is apparent from Table 2, through the method according to the present disclosure, high-quality naphthenic base oil was produced, which had a naphthene content of about 57.7% and thus was enriched in naphthene, with a kinetic viscosity of about 9.31.4 cSt at 40° C., and in which the amounts of sulfur, nitrogen and aromatic components were much lower than those of the feedstock.

TABLE 2

| | | LCO | N9 |
|---|---|---|---|
| Pour Point | ° C. | 0 | −50 |
| Kvis | 40° C. | 8.717 | 9.314 |
| | 100° C. | 2.046 | 2.286 |
| Sulfur | wt. ppm | 6600 | 14.3 |
| Nitrogen | wt. ppm | 1166 | 1.89 |
| Hydrocarbon | Cn % | — | 57.7 |
| Gas Absorptiveness | | | +8.51 |
| HPLC (Aromatic Analysis) | MAH % | 5.4 | 43.94 |
| | DAH % | 13.7 | 2.7 |
| | PAH % | 55.8 | 0.35 |
| | TAH % | 74.8 | 46.99 |

EXAMPLE 2

Production of Naphthenic Base Oil from Deasphalted Oil

In the present example related to a method of manufacturing naphthenic base oil from deasphalted oil obtained through solvent deasphalting of slurry oil, slurry oil was subjected to solvent extraction using propane as a solvent, thus obtaining deasphalted oil, which was then used as an actual feedstock, thereby manufacturing naphthenic base oil.

The solvent deasphalting (for pretreatment of slurry oil) was conducted under operating conditions including a pressure of an asphaltene separator of 40-50 kg/cm$^2$, a separation temperature of deasphalted oil and pitch of 40-180° C., and a ratio of solvent to oil (L/kg) of 4:1-12:1.

The hydrotreating process was conducted using the same nickel-molybdenum catalyst as in Example 1, under operating conditions including LHSV of 0.1-3.0 h$^{-1}$, hydrogen consumption of 500-2500 Nm$^3$/m$^3$ based on H2/oil, a reaction pressure of 30-220 kg/cm$^2$, and a reaction temperature of 280-430° C.

The dewaxing process was conducted using a NiMo/zeolite catalyst, and the hydrofinishing process was conducted using a PtPd/Al$^2$O$^3$ catalyst. These processes were carried out under operating conditions including LHSV of 0.1-3.0 h$^{-1}$, hydrogen consumption of 300-1000 Nm$^3$/m$^3$ based on 112/oil, and a reaction pressure of 10-200 kg/cm$^2$. As such, the reaction temperature was set to 250-430° C. for dewaxing and 150-400° C. for hydrofinishing.

Table 3 below shows the properties of the first feedstock (SLO), the actual feedstock (DAO), and the oil fraction after DW (before separation using a fractionator).

TABLE 3

| | | SLO | DAO | After DW |
|---|---|---|---|---|
| Pour Point | ° C. | 10 | 9 | −45 |
| Kvis | 40° C. | — | 75.04 | 20.39 |
| | 100° C. | 14.35 | 5.95 | 3.557 |
| Sulfur | wt. ppm | 7200 | 6004 | 27.33 |
| Nitrogen | wt. ppm | 2895 | 1425 | 1.78 |
| HPNA | 11 ring+ | 202 | 93 | 12 |
| | Total | 1251 | 394 | 26 |
| Hydrocarbon | Cn % | — | — | 61 |
| HPLC | MAH % | 5.2 | 5.8 | 22.2 |
| | DAH % | 8.2 | 7.3 | 0.7 |
| | PAH % | 72.4 | 59.1 | 3.3 |
| | TAH % | 85.8 | 72.2 | 26.2 |

In the deasphalted oil obtained through solvent deasphalting, sulfur was decreased by about 16.67% and nitrogen was decreased by about 50.77%, compared to the slurry oil used as the first feedstock. Further, the total aromatic content was decreased by about 15.85%. Although the dewaxed oil fraction could be used as a product in that state, in order to ensure various products, it was separated using a fractionator in the hydrofinishing process. The properties of final products are summarized in Table 4 below.

In the case of N9 product, the gas absorptiveness was measured to be +14.96. From this, the gas absorptiveness which is a product standard could be verified to be adjusted through control of an aromatic content using hydrofinishing.

TABLE 4

| | | N9 | N46 | N110 | N540 |
|---|---|---|---|---|---|
| Pour Point | ° C. | −48 | −27 | −21 | −12 |
| Kvis | 40° C. | 9.8 | 21.7 | 108.3 | 532.7 |
| | 100° C. | 2.3 | 4.8 | 7.4 | 20.1 |
| Sulfur | wt. ppm | 5.39 | 6.21 | 16.7 | 152.3 |
| Nitrogen | wt. ppm | 0.52 | 3.67 | 5.02 | 40.52 |
| Hydrocarbon | Cn % | 65.2 | 59.6 | 54 | 38 |
| Gas Absorptiveness | | +14.96 | — | — | — |
| HPLC (Aromatic Analysis) | MAH % | 29.44 | 46.04 | 41.18 | 31.22 |
| | DAH % | 1.19 | 4.43 | 6.66 | 3.47 |
| | PAH % | 0.27 | 1.07 | 1.97 | 2.15 |
| | TAH % | 30.9 | 51.54 | 49.81 | 36.84 |

In the present example, the amounts of impurities and aromatics in the deasphalted oil were much lower than those of the light slurry oil. Accordingly, extreme conditions of the hydrotreating process could be considered considerably mitigated. The final oil fraction was separated into various products including N9/46/110/540 using a fractionator in the hydrofinishing process.

Further, in the dewaxing process, the NiMo/zeolite catalyst was used, thereby preventing the excessive saturation of the mono-aromatic component so that the aromatic component remained in an appropriate amount in the subsequent hydrofinishing process. When the aromatic saturation is controlled at a desired level, the gas absorptiveness and oxidation stability corresponding to the product standards can be appropriately adjusted.

EXAMPLE 3

Production of Naphthenic Base Oil from Mixture of Deasphalted Oil and Light Cycle Oil In the present example, naphthenic base oil was produced from a mixture of light cycle oil and deasphalted oil obtained through solvent deasphalting of slurry oil.

As such, the solvent deasphalting process was conducted using propane as a solvent under operating conditions including a pressure of an asphaltene separator of 40-50 kg/cm$^2$, a separation temperature of deasphalted oil and pitch of 40-180° C., and a ratio of solvent to oil (L/kg) of 4:1~12:1.

The deasphalted oil (DAO) was mixed with light cycle oil at almost a 1:1 mass ratio.

The hydrotreating process was conducted using the same nickel-molybdenum catalyst as in Example 2 under operating conditions including LHSV of 0.1-3.0 h$^{-1}$, hydrogen consumption of 500-2500 Nm$^3$/m$^3$ based on H2/oil, a reaction pressure of 30-220 kg/cm$^2$, and a reaction temperature of 280-430° C.

The dewaxing process was conducted using a NiMo/zeolite catalyst, and the hydrofinishing process was conducted using a PtPd/Al$^2$O$^3$ catalyst. These processes were carried out under operating conditions including LHSV of 0.1-3.0 h$^{-1}$, hydrogen consumption of 300-1000 Nm$^3$/m3 based on H2/oil, and a reaction pressure of 10-200 kg/cm$^2$. As such, Hie reaction temperature was set to 250-430° C. for dewaxing and to 150-400° C. for hydrofinishing.

Table 5 below shows the properties of the first feedstock (LCO/SLO) and the actual feedstock (LCO+DAO).

TABLE 5

| | | LCO | SLO | DAO | LCO + DAO |
|---|---|---|---|---|---|
| Pour Point | ° C. | 0 | 10 | 9 | 3 |
| Kinetic Viscosity | 40° C. | 8.717 | — | 75.04 | 23.16 |
| | 100° C. | 2.046 | 14.35 | 5.95 | 3.413 |
| Sulfur | wt. ppm | 6600 | 7200 | 6004 | 6300 |
| Nitrogen | wt. ppm | 1166 | 2895 | 1425 | 1851 |
| HPNA | 11 ring+ | 70 | 202 | 93 | 169 |
| | Total | 239 | 1251 | 394 | 481 |
| HPLC | MAH % | 5.40 | 5.2 | 5.8 | 6.1 |
| (Aromatic | DAH % | 13.70 | 8.2 | 7.3 | 19 |
| Analysis) | PAH % | 55.80 | 72.4 | 59.1 | 42.89 |
| | TAH % | 74.80 | 85.8 | 72.2 | 67.99 |

The effluent of the dewaxing unit was separated into final products according to the viscosity. The properties of the products are summarized in Table 6 below.

TABLE 6

| | | N5 | N9 | N46 | N220 |
|---|---|---|---|---|---|
| Pour Point | ° C. | −50 | −48 | −27 | −22 |
| Kvis | 40° C. | 4.3 | 9.2 | 44.5 | 219 |
| | 100° C. | 1.5 | 2.3 | 4.8 | 12.14 |
| Sulfur | wt. ppm | 4.64 | 5.6 | 23.6 | 25.8 |
| Nitrogen | wt. ppm | 3.82 | 3.59 | 5.7 | 4.59 |
| Hydrocarbon | Cn % | 59.4 | 57.7 | 55.6 | 50.3 |
| Gas Absorptiveness | | — | +15.3 | — | — |
| HPLC (Aromatic | MAH % | 20.82 | 33.06 | 36.65 | 26.48 |
| Analysis) | DAH % | 0.22 | 0.65 | 1.77 | 2.22 |
| | PAH % | 0.05 | 0.12 | 0.41 | 0.86 |
| | TAH % | 21.09 | 33.83 | 38.83 | 29.56 |

In the present example, although the final oil fraction could be used as a product in that state, it was separated into four products using a fractionator according to kinetic viscosity at 40° C. in consideration of various differing applications of naphthenic base oil. Consequently, products having various viscosity standards, in which the amounts of sulfur, nitrogen and so on were drastically reduced compared to those of the feedstock and which was enriched in naphthene and had superior low-temperature performance, were produced.

The foregoing examples are provided merely for the purpose of explanation and are in no way to be construed as limiting. While reference to various embodiments are shown, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

The invention claimed is:

1. A method of manufacturing a naphthenic base oil from a hydrocarbon feedstock having a boiling point higher than that of gasoline and containing heteroatom species and an aromatic material, comprising:

(a) separating a light cycle oil and a slurry oil from oil fractions obtained through fluidized catalytic cracking;

(b) separating the slurry oil separated in step (a) into a deasphalted oil and a pitch through solvent deasphalting;

(c) hydrotreating the light cycle oil separated in step (a), the deasphalted oil separated in step (b), or a mixture thereof, using a hydrotreating catalyst to produce a hydrotreated oil fraction having a reduced amount of heteroatom species;

(d) dewaxing the entire hydrotreated oil fraction, obtained, in step (c), using is dewaxing catalyst to produce a dewaxed oil fraction having a lowered pour point, the dewaxing catalyst comprising a support selected from the group consisting of molecular sieve, alumina and silica-alumina, and a combination of (i) Ni or Co,and (ii) Mo or W as a hydrogenation metal component;

(e) hydrofinishing the dewaxed oil fraction, obtained in step (d), using a hydrofinishing catalyst to produce a hydrofinished oil fraction with the aromatic content thereof adjusted to comply with a product standard; and (f) separating the hydrofinished oil fraction, obtained in step (e), according to a range of viscosity, wherein steps (a) through (f) are carried out successively such that no hydroprocessig steps are conducted between the hydrotreating step (c) and the dewaxing step (d), wherein the light cycle oil separated in step (a), the deasphalted oil separated in step (b), or the mixture thereof has an aromatic content of 60 wt% or more, wherein the hydrotreated oil fraction in step (c) has a sulfur content of less than 200 ppm, a nitrogen content of less than 100 ppm, an aromatic content of less than 60 wt% and a poly-aromatic content of not more than 5%, and wherein the naphthenic base oil has a viscosity index of 85 or less, in which at least 30% of the carbon bonds thereof are of a naphthenic type according to ASTM D-2140, and has a naphthene content of 40 wt% or more.

2. The method according to claim 1, wherein the light cycle oil, the deasphalted oil, or the mixture thereof has a sulfur content of 0.5 wt% or more, and a nitrogen content of 1000 ppm or more.

3. The method according to claim 1, wherein the separating in step (b) is conducted under operating conditions including a pressure of an asphaltene separator of 40 to 50 kg/cm$^2$, a separation temperature of deasphalted oil and pitch of 40 to 180° C., and a ratio of solvent to oil (L/kg) of 4:1 to 12:1.

4. The method according to claim 1, wherein the hydrotreating in step (c) is conducted under operating conditions including a temperature of 280 to 430° C., a pressure of 30 to 220 kg/cm$^2$, a liquid hourly space velocity of 0.1 to 3.0 h$^{-1}$, and a volume ratio of hydrogen to feedstock of 500 to 2500 Nm$^3$/m$^3$.

5. The method according to claim 1, wherein the hydrotreating catalyst used in step (c) comprises metals selected from metals of Group 6 and Groups 9 and 10 in the Periodic Table.

6. The method according to claim 5, wherein the hydrotreating catalyst used in step (c) comprises one or more selected from the group consisting of CoMo, NiMo, and a combination of CoMo and NiMo.

7. The method according to claim 1, wherein the dewaxing in step (d) is conducted under operating conditions including a temperature of 250 to 430° C., a pressure of 10 to 200 kg/cm$^2$, a liquid hourly space velocity of 0.1 to 3 h$^{-1}$, and a volume ratio of hydrogen to feedstock of 300 to 1000 Nm$^3$/m$^3$.

8. The method according to claim 1, wherein the support of the dewaxing catalyst is at least one molecular sieve selected from the group consisting of SAPO-I 1, SAPO-41, ZSM-5, ZSM-I1, ZSM-22, ZSM-23, ZSM-35, ZSM-48, FAU, Beta, and MOR.

9. The method according to claim 1, wherein the hydrofinishing in step (e) is conducted under operating conditions including a temperature of 150 to 400° C., a pressure of 10 to 200 $kg/cm^2$, a liquid hourly space velocity of 0.1 to 3.0 $h^{-1}$, and a volume ratio of hydrogen to the supplied oil fraction of 300 to 1000 $Nm^3/m^3$.

10. The method according to claim 1, wherein the hydrofinishing catalyst used in step (e) comprises one or more metals selected from metals of Groups 6, 8, 9, 10 and 11 in the a Periodic Table.

11. The method according to claim 10, wherein the one or more metals of the hydrofinishing catalyst used in step (e) comprise one or more metals selected from the group consisting of Pt, Pd, Ni, Co, Mo, and W.

12. The method according to claim 1, wherein the separating in step (f) is conducted according to a kinetic viscosity at 40° C., and enables the hydrofinished oil fraction to be separated into naphthenic base oil products having kinetic viscosities at 40° C. of 3 to 5 cSt, 8 to 10 cSt, 18 to 28 cSt, 43 to 57 cSt, 90 to 120 cSt, 200 to 240 cSt, and 400 cSt or more.

13. The method according to claim 1, wherein the naphthenic base oil has a sulfur content of 200 ppm or less.

14. The method according to claim 12, wherein the naphthenic base oil has a sulfur content of 200 ppm or less.

15. The method according to claim 12, wherein the naphthenic base oil products have a total aromatic content of 21.09 to 51.54 wt%.

* * * * *